US012233352B2

(12) United States Patent
Wang

(10) Patent No.: US 12,233,352 B2
(45) Date of Patent: Feb. 25, 2025

(54) SPLICING ANIMAL BUILDING BLOCK TOY

(71) Applicant: Zhejiang feiyuan Technology Co., Ltd, Hangzhou (CN)

(72) Inventor: Xueliang Wang, Jiaxing (CN)

(73) Assignee: Zhejiang feiyuan Technology Co., Ltd, Hangzhou (CN)

( * ) Notice: Subject to any disclaimer, the term of this patent is extended or adjusted under 35 U.S.C. 154(b) by 334 days.

(21) Appl. No.: 17/890,510

(22) Filed: Aug. 18, 2022

(65) Prior Publication Data

US 2024/0009587 A1 Jan. 11, 2024

(30) Foreign Application Priority Data

Jul. 7, 2022 (CN) ..... 202221739311.6

(51) Int. Cl.
*A63H 3/16* (2006.01)
*A63H 33/04* (2006.01)
*A63H 33/06* (2006.01)

(52) U.S. Cl.
CPC ..... *A63H 33/062* (2013.01)

(58) Field of Classification Search
CPC . A63H 3/16; A63H 3/46; A63H 33/04; A63H 33/046; A63H 33/06; A63H 33/062; A63H 33/08; A63H 33/086; A63H 33/042; A63H 33/26
USPC ..... 446/85, 97, 99, 102, 103, 108, 116, 397, 446/420
See application file for complete search history.

(56) References Cited

U.S. PATENT DOCUMENTS 858,090 A * 6/1907 Meinecke ..... A63H 3/16 446/99
2,752,726 A * 7/1956 Calverley ..... F16C 11/06 446/99
3,365,198 A * 1/1968 Hay ..... A63F 9/0098 428/3
3,375,604 A * 4/1968 Alonso ..... A63H 3/16 446/92
3,545,798 A * 12/1970 Kershaw ..... A63H 3/16 403/326
3,601,921 A * 8/1971 Strohmaier ..... A63H 33/046 446/92
4,118,888 A * 10/1978 Ogawa ..... A63H 33/26 124/16
4,186,515 A * 2/1980 Ogawa ..... A63H 3/16 446/99

(Continued)

FOREIGN PATENT DOCUMENTS

CN 208591540 U 3/2019
CN 210728673 U 6/2020
CN 216023173 U 3/2022

*Primary Examiner* — Alexander R Niconovich
(74) *Attorney, Agent, or Firm* — Nitin Kaushik

(57) ABSTRACT

Described herein is an assembled building block toy, and in particular to a splicing animal building block toy which consists of several different body part building blocks of different types of animals. The building blocks are divided into a head part building block, a body part building block, a limbs part building block, and a combined part building block, which are body parts of different types of animals. The connection structures at the splicing positions have the same design method, size and shape, making it possible to realize the mixed splicing use of building blocks of different types of animals and splice a variety of variant models.

5 Claims, 17 Drawing Sheets

(56) References Cited

U.S. PATENT DOCUMENTS 4,215,509 A * 8/1980 Mariol ..... A63H 3/16 446/99
4,604,073 A * 8/1986 Livesey ..... A63H 15/06 446/117
4,798,553 A * 1/1989 Gentles ..... A63H 7/06 446/99
5,104,345 A * 4/1992 Lyman ..... A63H 33/08 446/101
5,378,184 A * 1/1995 Bro ..... A63H 3/16 446/99
5,746,638 A * 5/1998 Shiraishi ..... A63H 33/046 446/131
5,752,869 A * 5/1998 Huff ..... A63H 3/16 446/104
5,779,515 A * 7/1998 Chung ..... A63H 33/04 446/90
6,439,951 B1 * 8/2002 Kawakita ..... H01R 13/62 446/376
6,461,215 B1 * 10/2002 Kunz ..... A63H 33/042 446/124
6,482,063 B1 * 11/2002 Frigard ..... A63H 33/103 446/124
6,887,120 B2 * 5/2005 Shamitoff ..... A63H 3/46 446/376
7,371,147 B2 * 5/2008 Tusacciu ..... A63H 33/046 446/85
7,766,716 B2 * 8/2010 Fong ..... A63H 3/16 446/99
7,892,065 B2 * 2/2011 Vicentelli ..... A63H 33/046 446/85
7,955,155 B2 * 6/2011 Tremblay ..... A63H 33/046 446/85
8,790,151 B2 * 7/2014 Bertrand ..... A63H 33/046 446/128
8,998,670 B1 * 4/2015 De Leon ..... A63H 3/46 446/97
9,539,520 B2 * 1/2017 Rotbard ..... A63H 33/042
9,573,074 B2 * 2/2017 Ryaa ..... A63H 33/04
9,669,324 B2 * 6/2017 Roth ..... A63H 33/08
11,077,385 B2 * 8/2021 Kogure ..... A63H 33/10
11,241,634 B2 * 2/2022 Lawber ..... A63H 33/26
11,406,909 B2 * 8/2022 Zhang ..... A63H 33/26
11,458,410 B2 * 10/2022 Xu ..... A63H 33/046
12,005,371 B2 * 6/2024 Ito ..... A63H 3/04
2010/0041300 A1 * 2/2010 Bevirt ..... F16M 11/14 446/97
2012/0309257 A1 * 12/2012 McDonald ..... A63H 33/003 446/85
2013/0040531 A1 * 2/2013 Ferron ..... A63H 3/46 446/85
2013/0316610 A1 * 11/2013 Maddocks ..... A63H 33/086 446/85

* cited by examiner

1

2

3

4

3

4

5

SPLICING ANIMAL BUILDING BLOCK TOY

CROSS-REFERENCE TO RELATED APPLICATIONS

The application claims priority to Chinese patent application No. 2022217393116, filed on Jul. 7, 2022, the entire contents of which are incorporated herein by reference.

TECHNICAL FIELD

The application relates to an assembled building block toy, and in particular to a splicing animal building block toy.

BACKGROUND

Splicing building blocks are usually made of wood or plastic, with free combination and simple splicing. It is beneficial to improving the children's ability of body coordination and balance through their hand touch and eye observation. However, the splicing animal building blocks currently on the market are single in form, have a multitude of parts with complicated assembly, and do not have an easy-to-control tightness, without high entertainment or interest.

SUMMARY

A technical problem to be solved by the application is to provide a splicing animal building block toy with simple structure, fast assembly speed and diverse playing ways, which can effectively improve entertainment and interest of use.

In order to solve the above problem, the splicing animal building block toy described in the application is characterized in that it consists of several different body part building blocks of different types of animals. The building blocks in the said splicing animal building block toy are divided into four types according to different body parts: a head part building block, a body part building block, a limbs part building block, and a combined part building block, with each type of building block designed in shape according to the conventional shapes of different types of animals.

The said head part building block consists of a head part building block base, a head part building block cover, a movable gear and a sounding plectrum. The said movable gear is placed in a head movable cavity formed by the head part building block base and the head part building block cover, and can move rotationally. The said movable gear is provided with an assembly hole in its center. The said sounding plectrum has a terminal end which is fixed and a head end which meshes with the teeth of the movable gear.

The said body part building block consists of a body part building block base, a body part building block cover and a splicing pillar. The said splicing pillar is placed in a movable cavity formed by the body part building block base and the body part building block cover, and can rotate around an axis. The body part building block base and the body part building block cover form limbs installation cavities in which barb steps are provided.

Each of the said limbs part building block consists of a limbs part building block base, a limbs part building block cover and magnets. The said magnets are placed in foot movable cavities formed by the limbs part building block base and the limbs part building block cover, and can rotate freely in the foot movable cavities to change an external magnetic pole. The limbs part building block base and the limbs part building block cover form a splicing buckle which is provided with a barb.

Due to the difference between body shapes of different types of animals, the combined part building block uses the combination of the body and the limbs, and consists of a combined part building block base, a combined part building block cover, a splicing pillar and magnets. The said splicing pillar is placed in a movable cavity formed by the combined part building block base and the combined part building block cover, and can rotate around an axis. The said magnets are placed in foot movable cavities formed by the combined part building block base and the combined part building block cover. The said magnets can rotate freely in the foot movable cavities to change an external magnetic pole.

The said body part building block and combined part building block are spliced into assembly holes in the movable gear of the head part building block through their respective splicing pillars. Each of the said splicing pillars and the assembly holes cannot slide rotationally relative to each other after assembly. In turning the body part building block, the combined part building block or the head part building block, the movable gear in the head part building block plucks the sounding plectrum to make a bouncing mechanical sound.

The said limbs part building blocks are spliced into the limbs installation cavities of the body part building block through the splicing buckles. The barbs in the said splicing buckles cooperate with the barb steps in the limbs installation cavities to improve the assembly tightness.

The head part building block, the body part building block, the limbs part building blocks and the combined part building block of the said splicing animal building block toy are designed according to the conventional shapes of different types of animals, making it possible to realize the mixed splicing use of building blocks of different types of animals and splice a variety of variant models to improve entertainment and interest.

The application has the following advantages over the prior art:

The application uses multiple snap points and barb structures, multiple assembly positions and a variety of building block shapes, with fast assembly, simple disassembly and diverse playing ways, which greatly improves entertainment and interest of building blocks.

Figure 1:
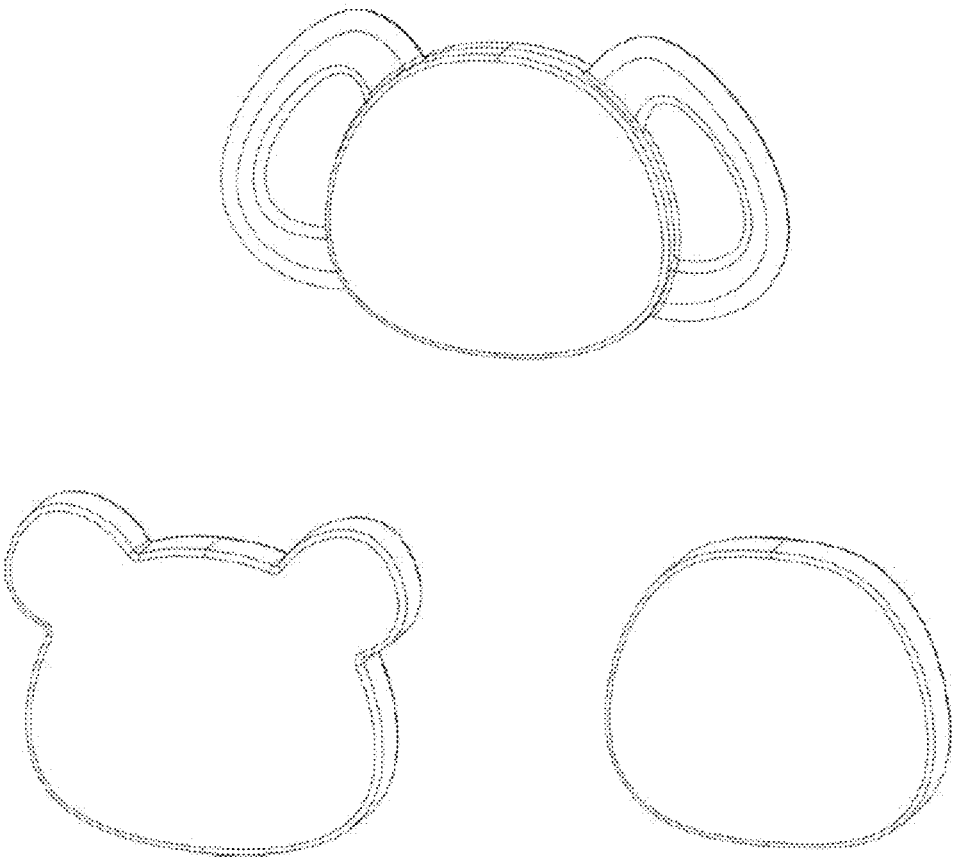
FIG. 1 is a schematic three-dimensional diagram of several kinds of head part building blocks exemplified in the application.

DESCRIPTION OF REFERENCE NUMERALS 1. head part building block, 11 head part building block base, 111 plectrum fixing pillar, 12 head part building block cover, 13 movable gear, 131 assembly hole in the movable gear, 14 sounding plectrum, 141 terminal end cavity of the sounding plectrum, 142 head end of the sounding plectrum, 15 head movable cavity;
2. body part building block, 21 body part building block base, 22 body part building block cover, 23 splicing pillar, 231 splicing rotation shaft, 24 body movable cavity, 25 limbs installation cavity, 26 barb step;
3. limbs part building block, 31 limbs part building block base, 32 limbs part building block cover, 33 magnets, 34 foot movable cavity, 35 splicing buckle, 36 barb; and
4. combined part building block, 41 combined part building block base, 42 combined part building block cover, 43 splicing pillar, 431 splicing rotation shaft, 44 magnets, 45 body movable cavity, 46 foot movable cavity. 5 assembled toys.

DETAILED DESCRIPTION OF THE EMBODIMENTS

Figure 2:
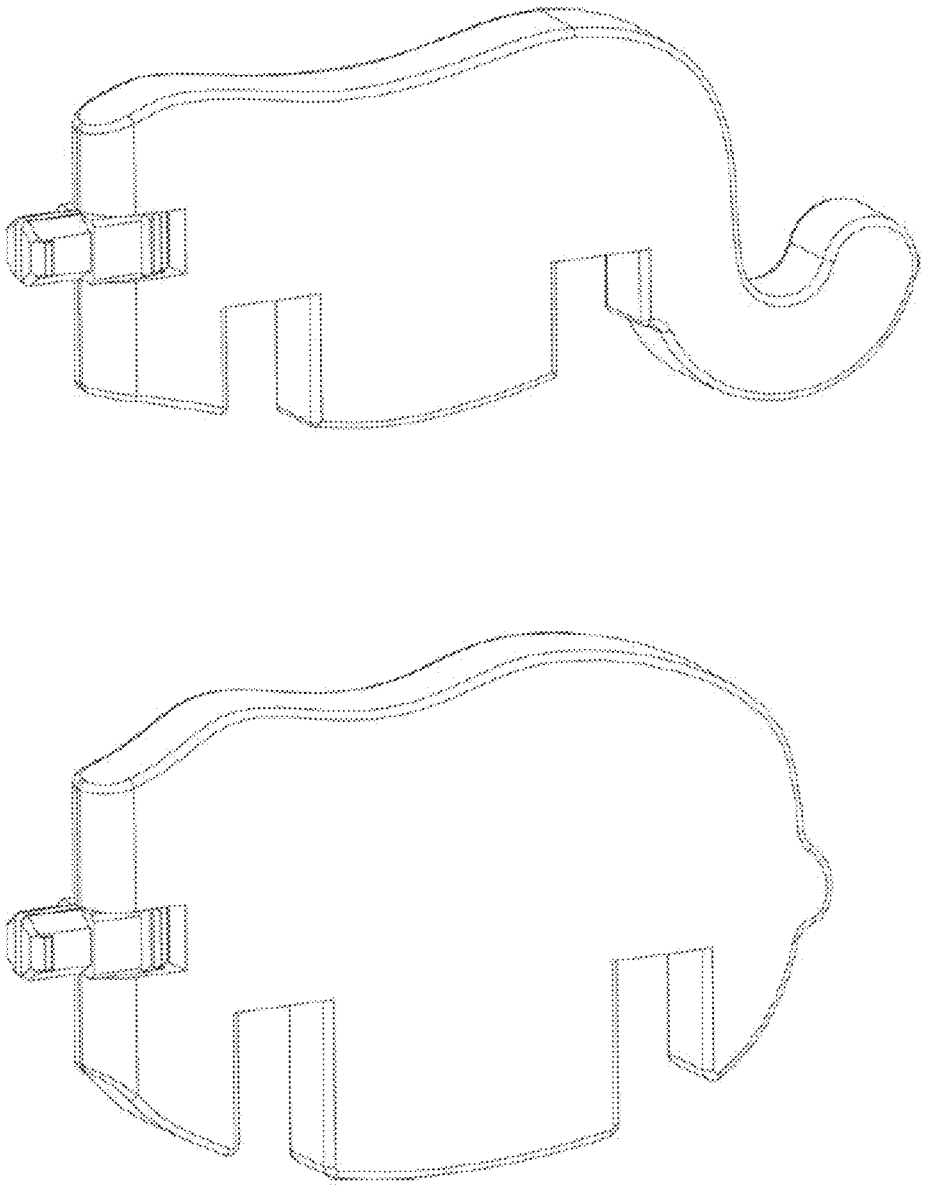
FIG. 2 is a schematic three-dimensional diagram of several kinds of body part building blocks exemplified in the application.
Figure 3:
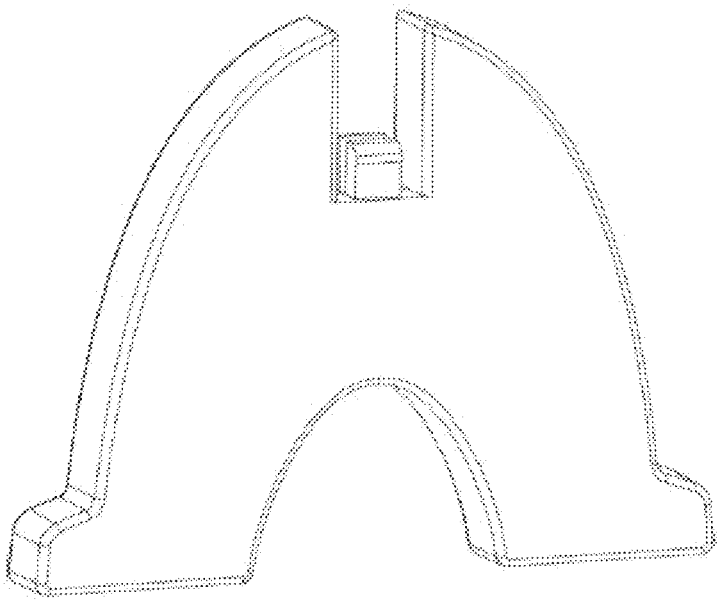
FIG. 3 is a schematic three-dimensional diagram of several kinds of limbs part building blocks exemplified in the application.
Figure 3:
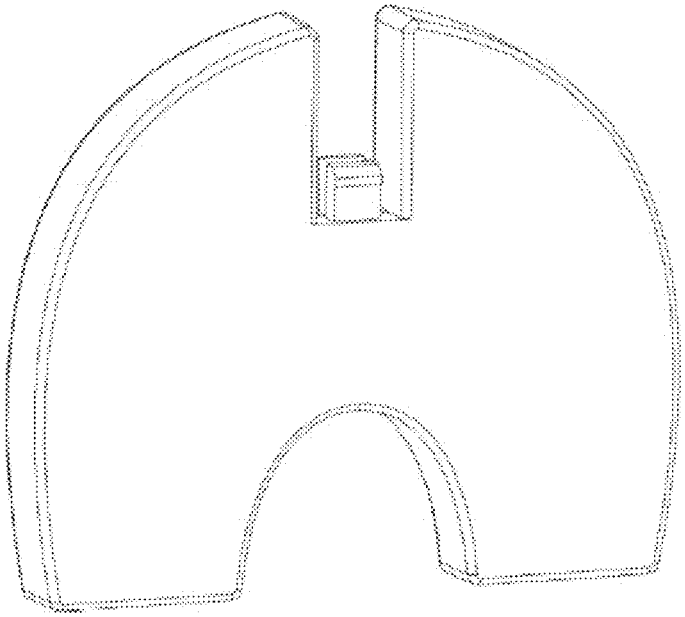
Figure 4:
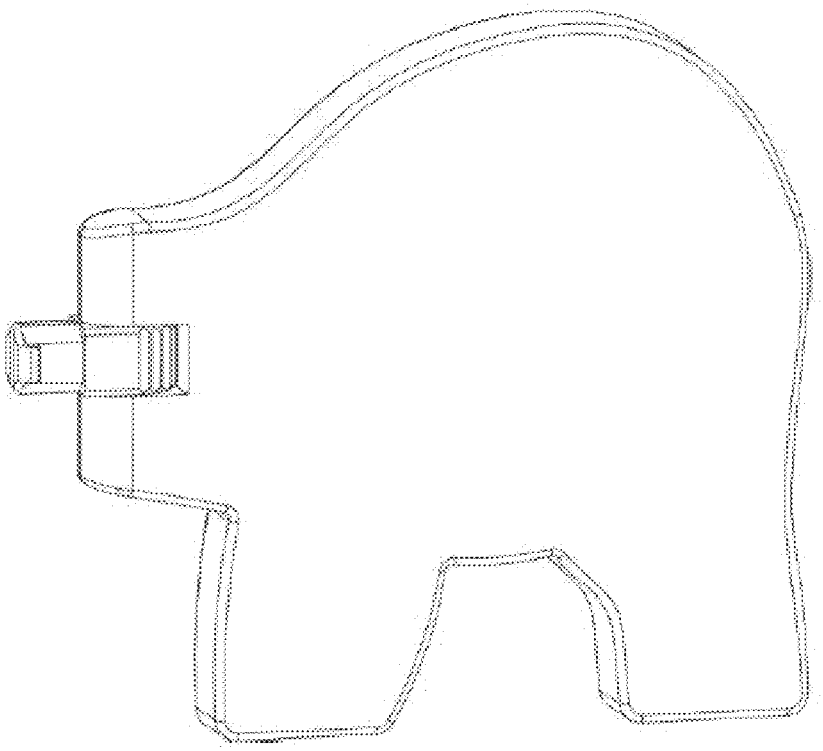
FIG. 4 is a schematic three-dimensional diagram of one of head part building blocks exemplified in the application.

Referring to FIGS. 1, 2, 3, and 4, building blocks of the shown splicing animal building block toy are divided into several embodiments according to different body parts: a head part building block 1 in FIG. 1, a body part building block 2 in FIG. 2, a limbs part building block 3 in FIG. 3 and a combined part building block 4 in FIG. 4, with each building block designed in shape according to the conventional shapes of different types of animals. The following description takes one of the embodiments for illustration.

Figure 5:
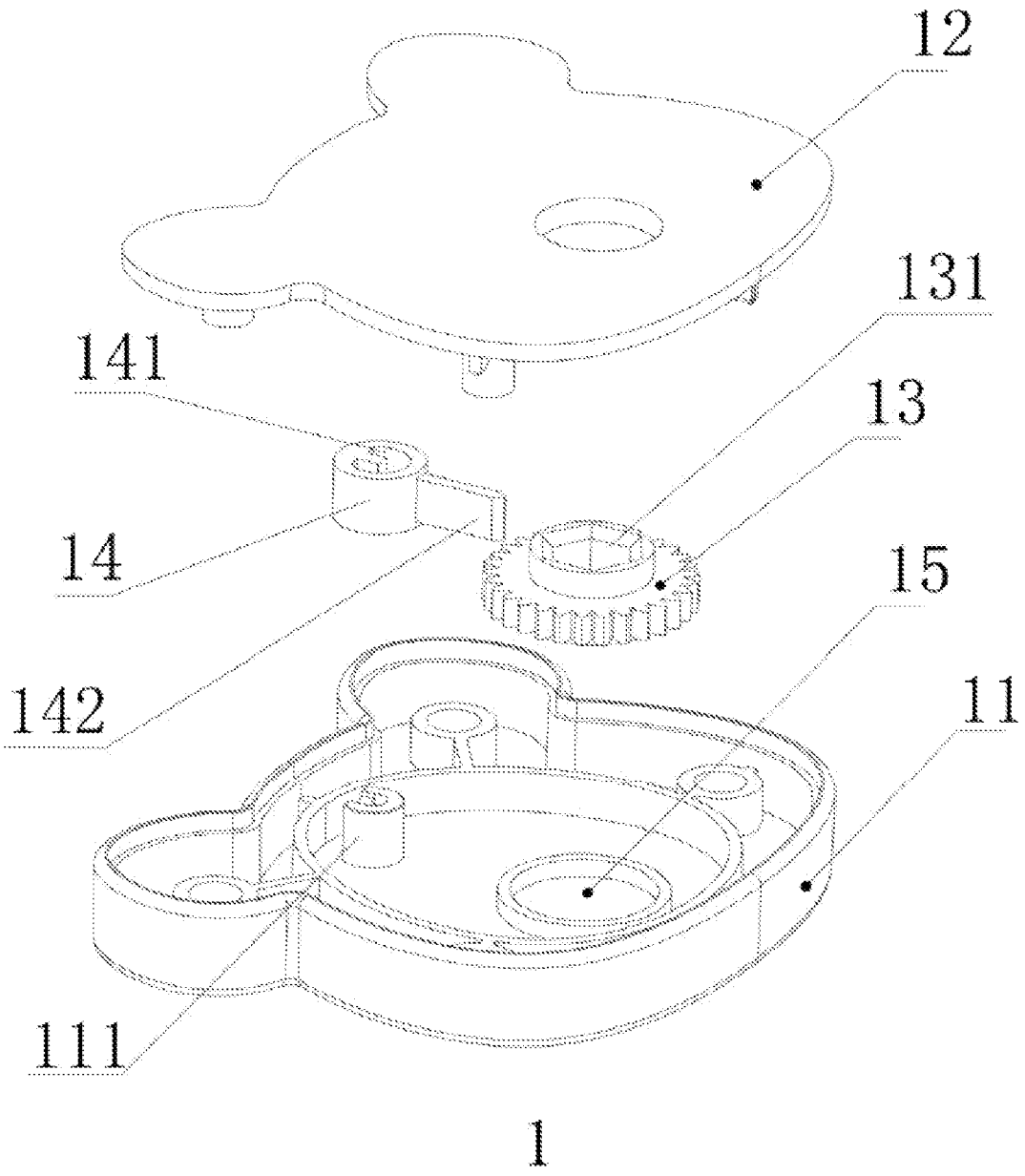
FIG. 5 is an exploded view of a head part building block in the application.
Figure 6:
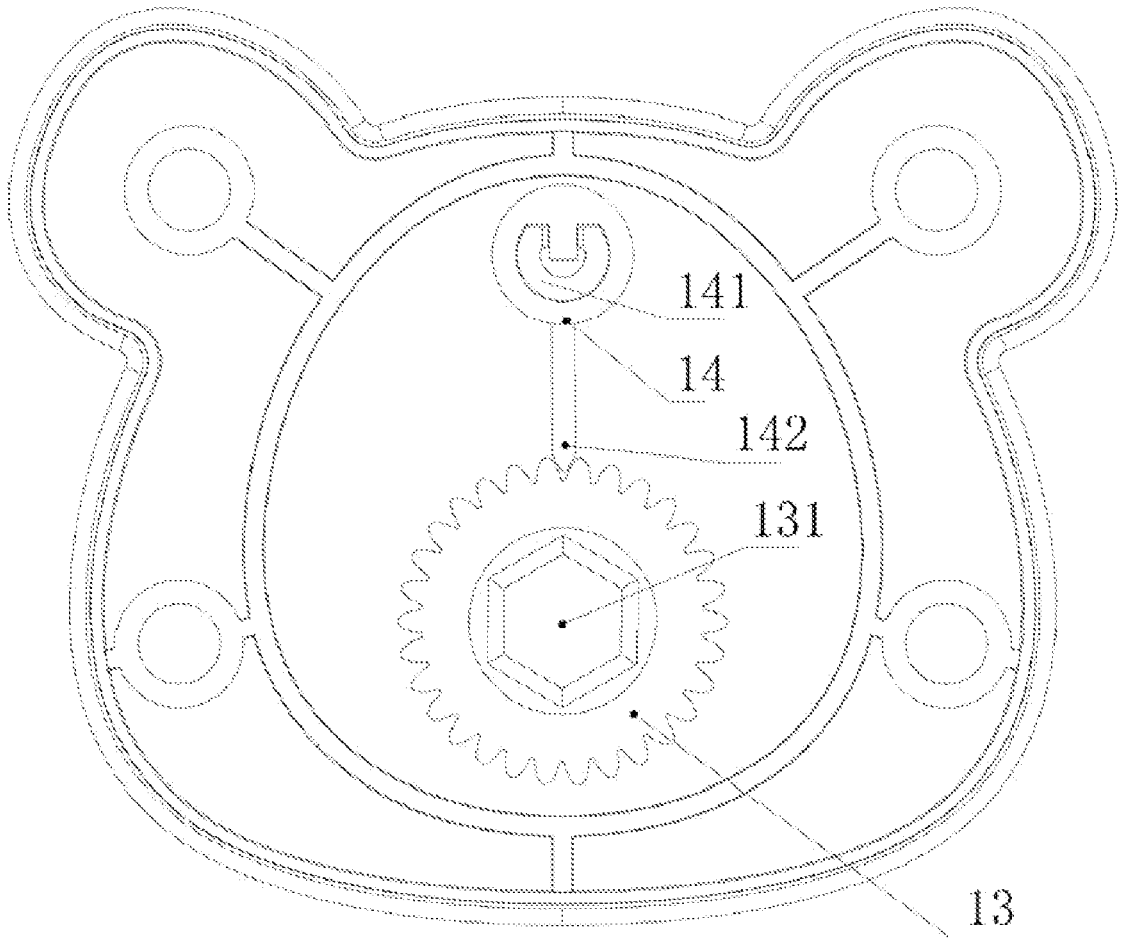
FIG. 6 is an arrangement diagram of internal parts of a head part building block in the application.

Referring to FIGS. 5 and 6, the shown head part building block 1 consists of a head part building block base 11, a head part building block cover 12, a movable gear 13 and a sounding plectrum 14. The shown movable gear 13 is placed in a head movable cavity 15 formed by the head part building block base 11 and the head part building block cover 12, and can move rotationally. The said movable gear 13 is provided with an assembly hole 131 in its center. The shown sounding plectrum 14 is fixed on a plectrum fixing pillar 111 of the building block base through a terminal end cavity 141, and a head end 142 meshes with the teeth of the movable gear 13.

Figure 7:
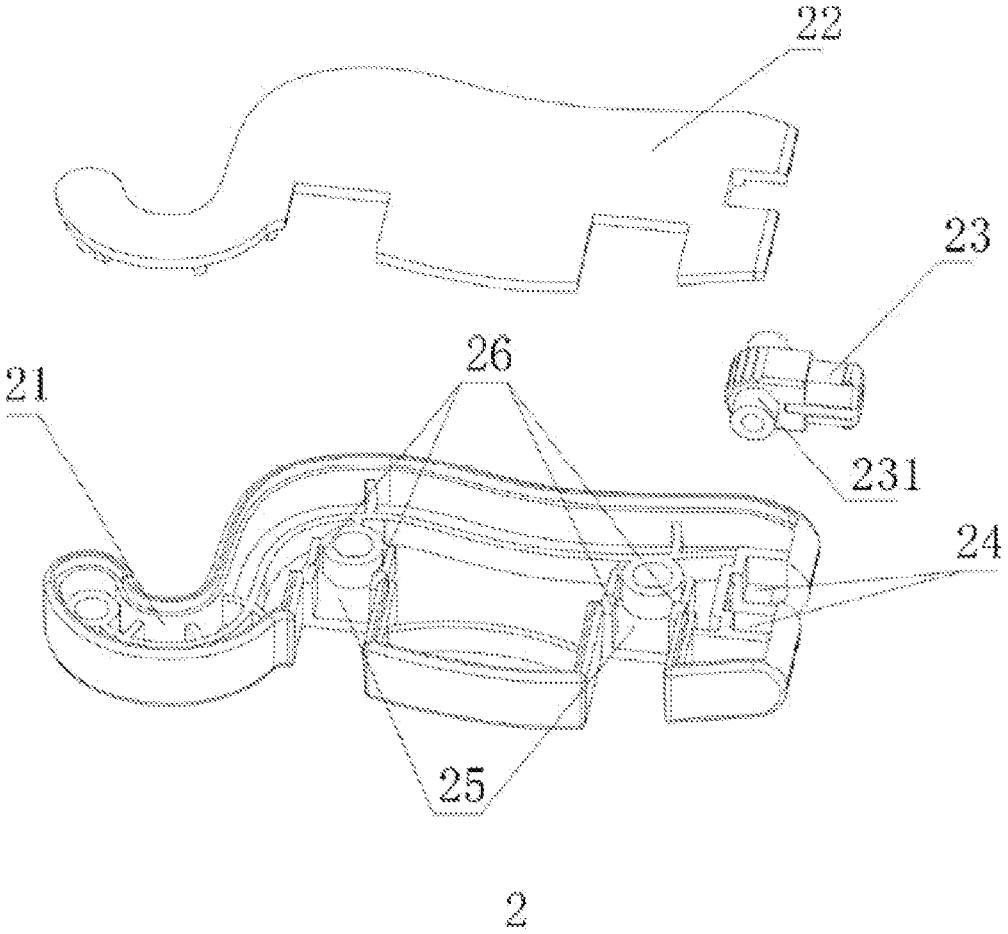
FIG. 7 is an exploded view of a body part building block in the application.
Figure 8:
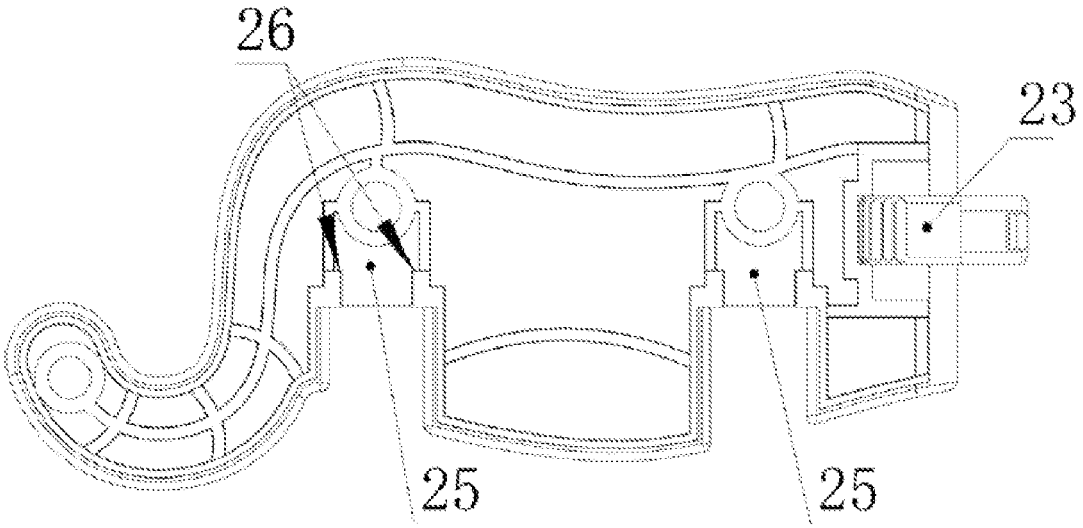
FIG. 8 is an arrangement diagram of internal parts of a body part building block in the application.

Referring to FIGS. 7 and 8, the shown body part building block 2 consists of a body part building block base 21, a body part building block cover 22 and a splicing pillar 23. A splicing rotation shaft 231 of the shown splicing pillar 23 is placed in a body movable cavity 24 formed by the body part building block base 21 and the body part building block cover 22, and can rotate around an axis. The body part building block base 21 and the body part building block cover 23 form limbs installation cavities 25 in which barb steps 26 are provided.

Figure 9:
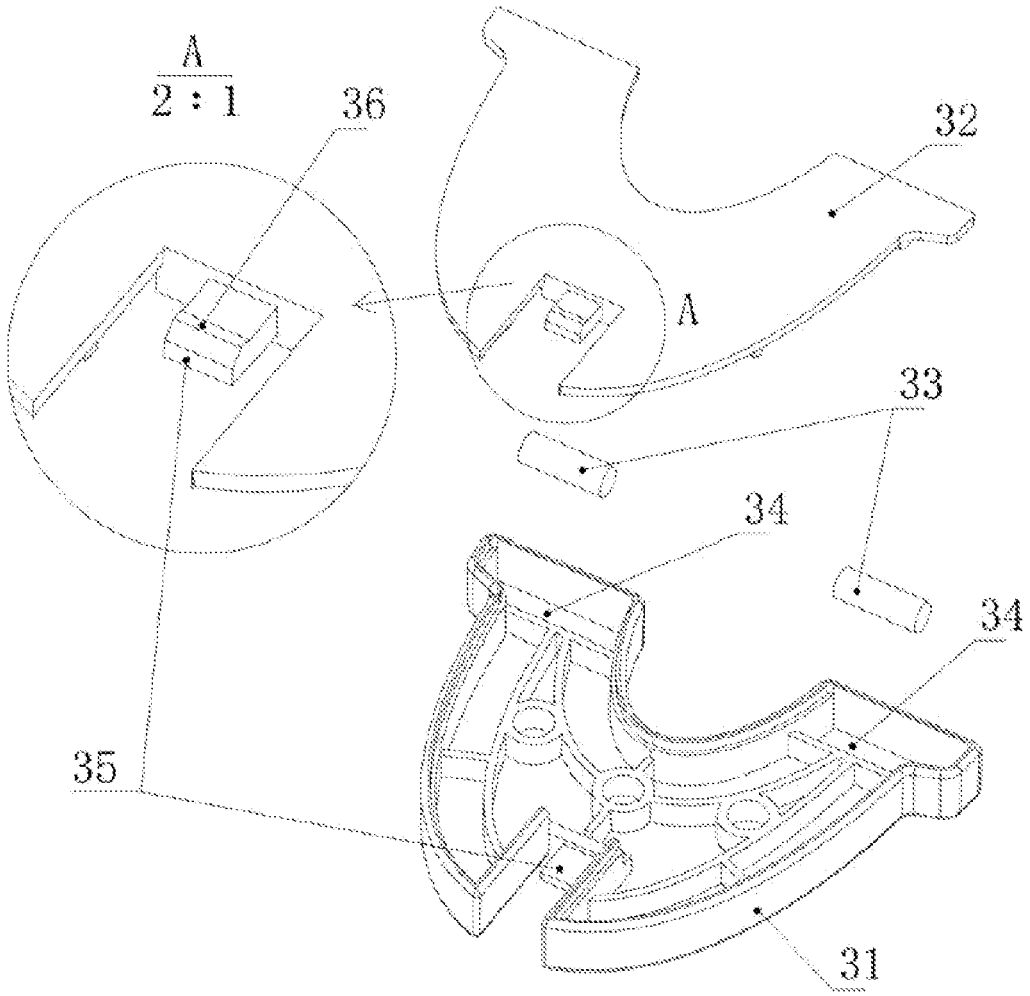
FIG. 9 is an exploded view of a limbs part building block in the application.
Figure 10:
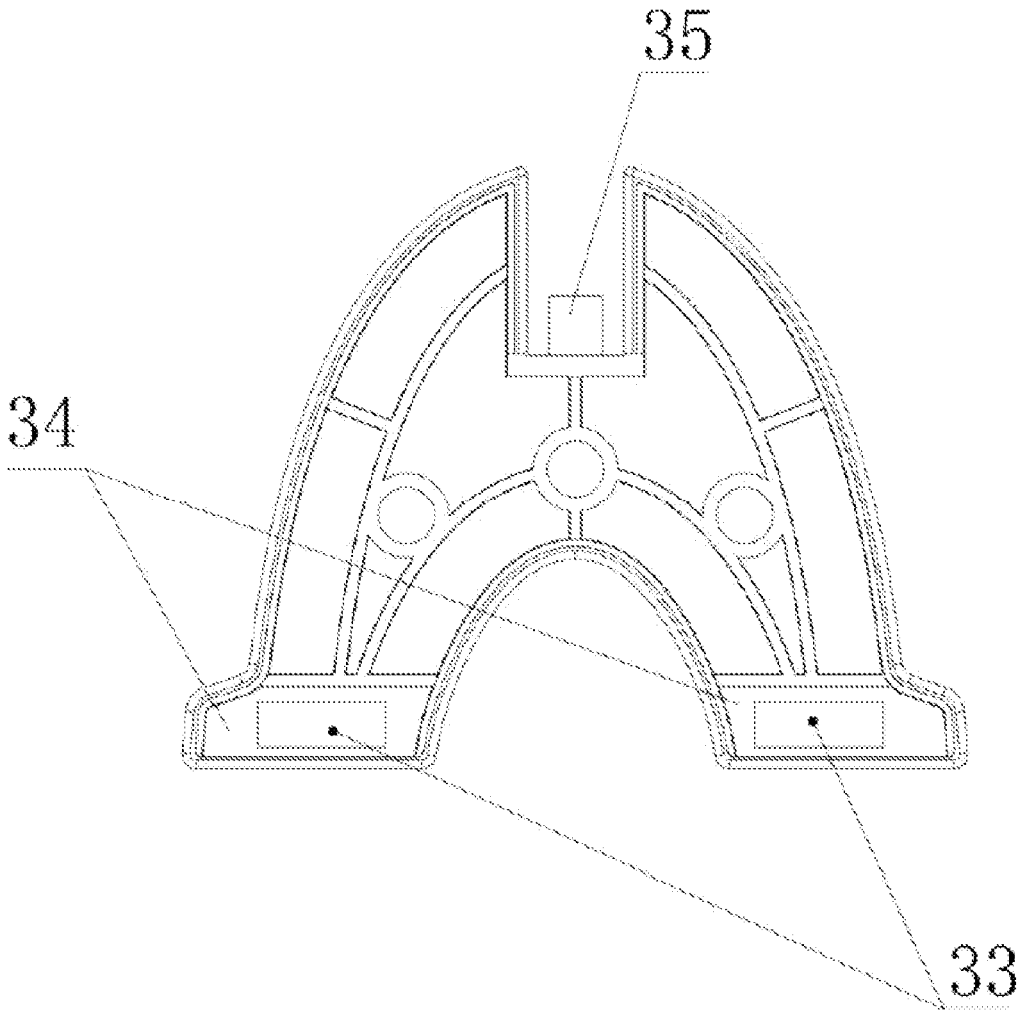
FIG. 10 is an arrangement diagram of internal parts of a limbs part building block in the application.

Referring to FIGS. 9 and 10, the shown limbs part building block 3 consists of a limbs part building block base 31, a limbs part building block cover 32 and magnets 33. The shown magnets 33 are placed in foot movable cavities 34 formed by the limbs part building block base 31 and the limbs part building block cover 32. Magnetic poles of the shown magnets 33 are fixed and can rotate freely in the foot movable cavities 34. The limbs part building block base 31 and the limbs part building block cover 33 form a splicing buckle 35 which is provided with a barb 36.

Figure 11:
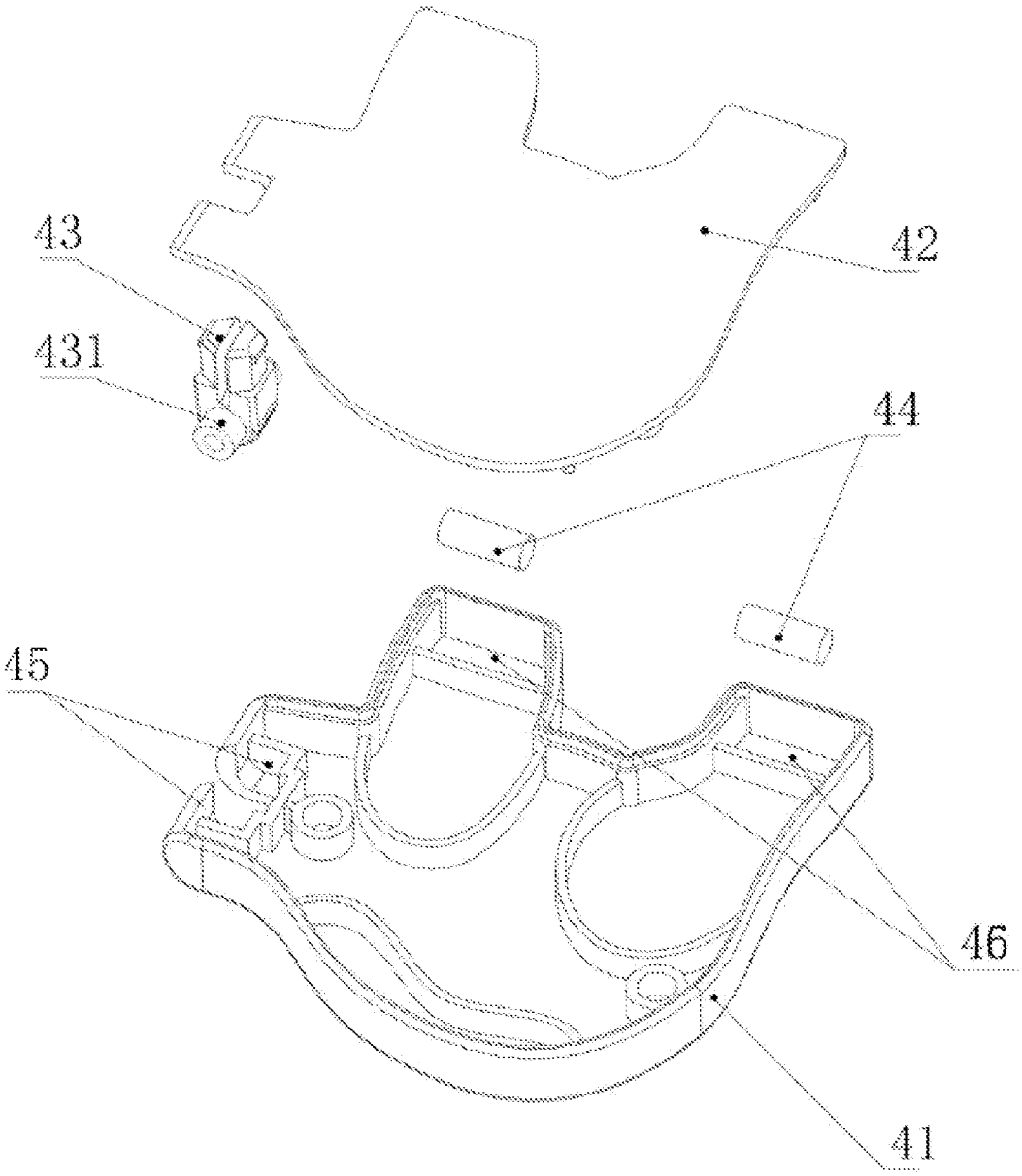
FIG. 11 is an exploded view of a combined part building block in the application.
Figure 12:
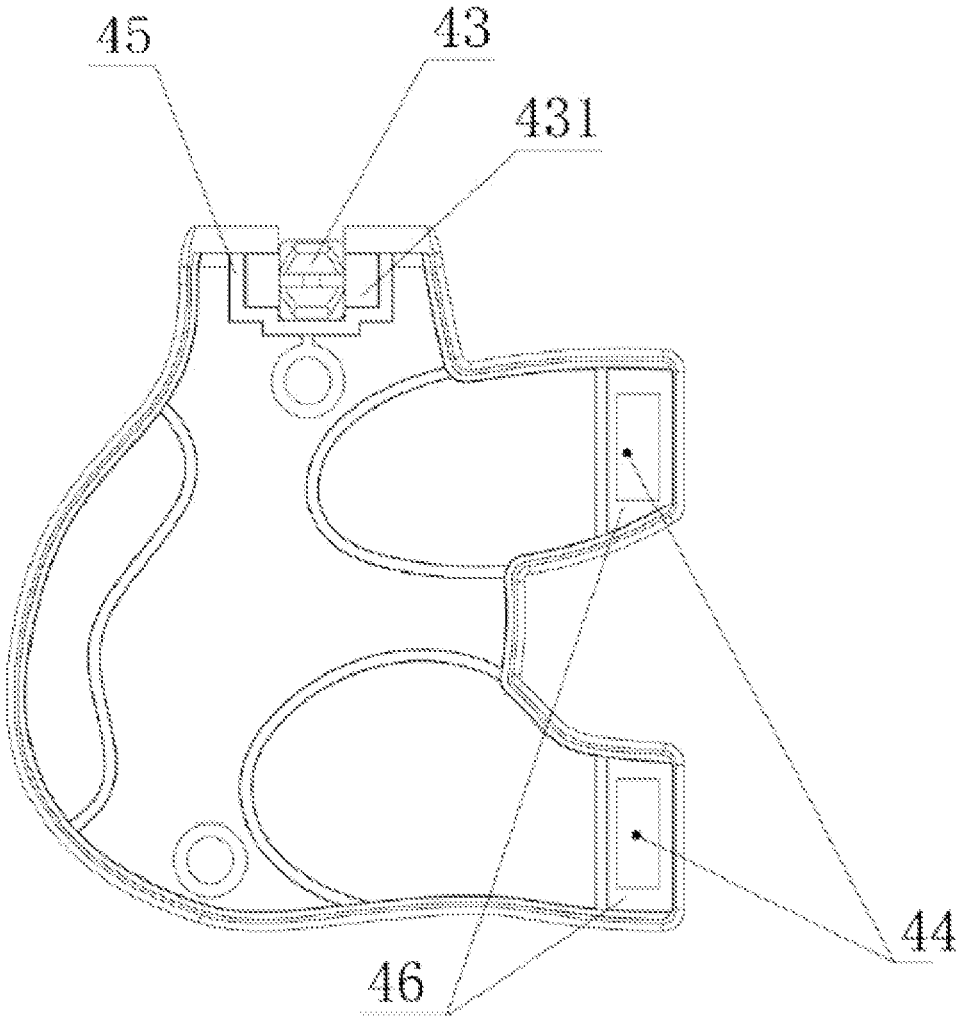
FIG. 12 is an arrangement diagram of internal parts of a combined part building block in the application.

Referring to FIGS. 11 and 12, due to the difference between body shapes of different types of animals, the combined part building block 4 where the body and the limbs are combined is also used. The shown combined part building block 4 consists of a combined part building block base 41, a combined part building block cover 42, a splicing pillar 43 and magnets 44. A splicing rotation shaft 431 of the shown splicing pillar 43 is placed in a body movable cavity 45 formed by the combined part building block base 41 and the combined part building block cover 42, and can rotate around an axis. The shown magnets 44 are placed in foot movable cavities 46 formed by the combined part building block base 41 and the combined part building block cover 43. Magnetic poles of the shown magnets 44 are fixed and can rotate freely in the foot movable cavities 46.

Figure 13:
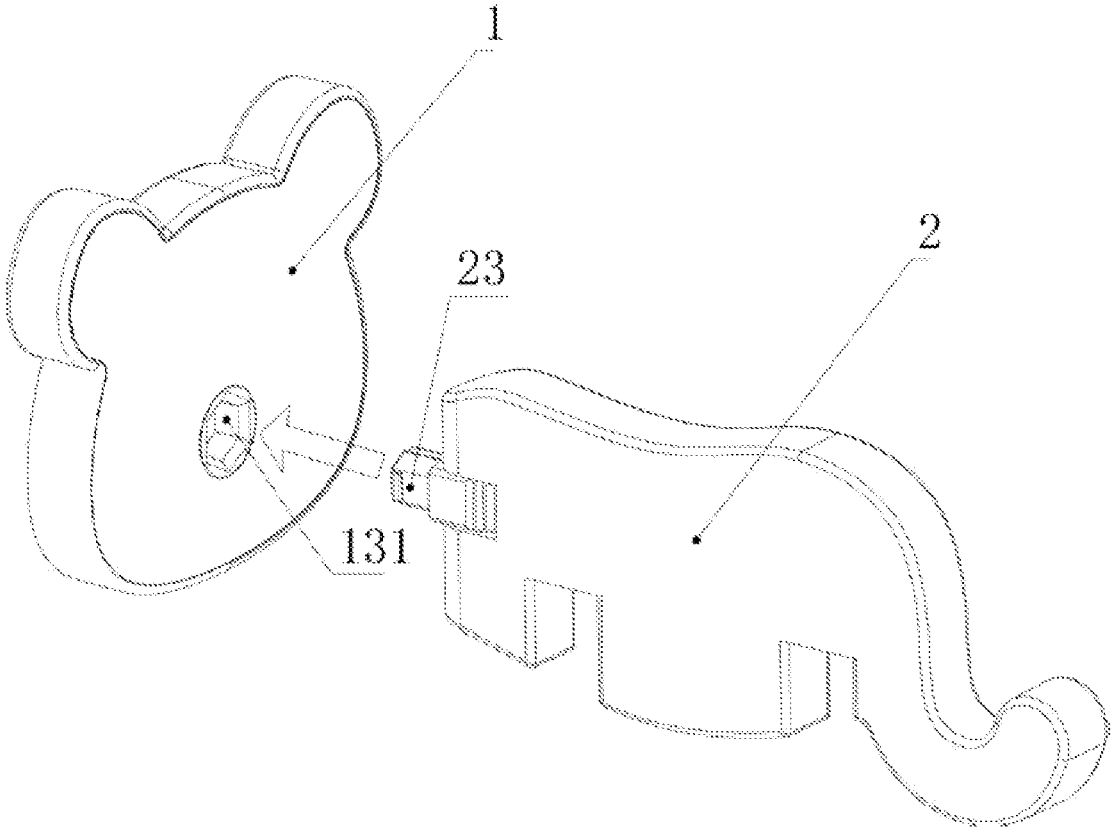
FIG. 13 is a schematic assembly diagram of a body part building block and a head part building block in the application.

Referring to FIGS. 6 and 13, the shown body part building block 2 is spliced into the assembly hole 131 in the movable gear of the head part building block 1 through the splicing pillar 23. After assembled, the shown splicing pillar 23 and the assembly hole 131 cannot slide rotationally relative to each other due to the polygonal assembly between their hole sites. In turning the body part building block 1 or the head part building block 2, the movable gear 13 plucks the sounding plectrum 14 to make a bouncing sound whose intensity can be adjusted by changing the material and length of the sounding plectrum 14.

Figure 14:
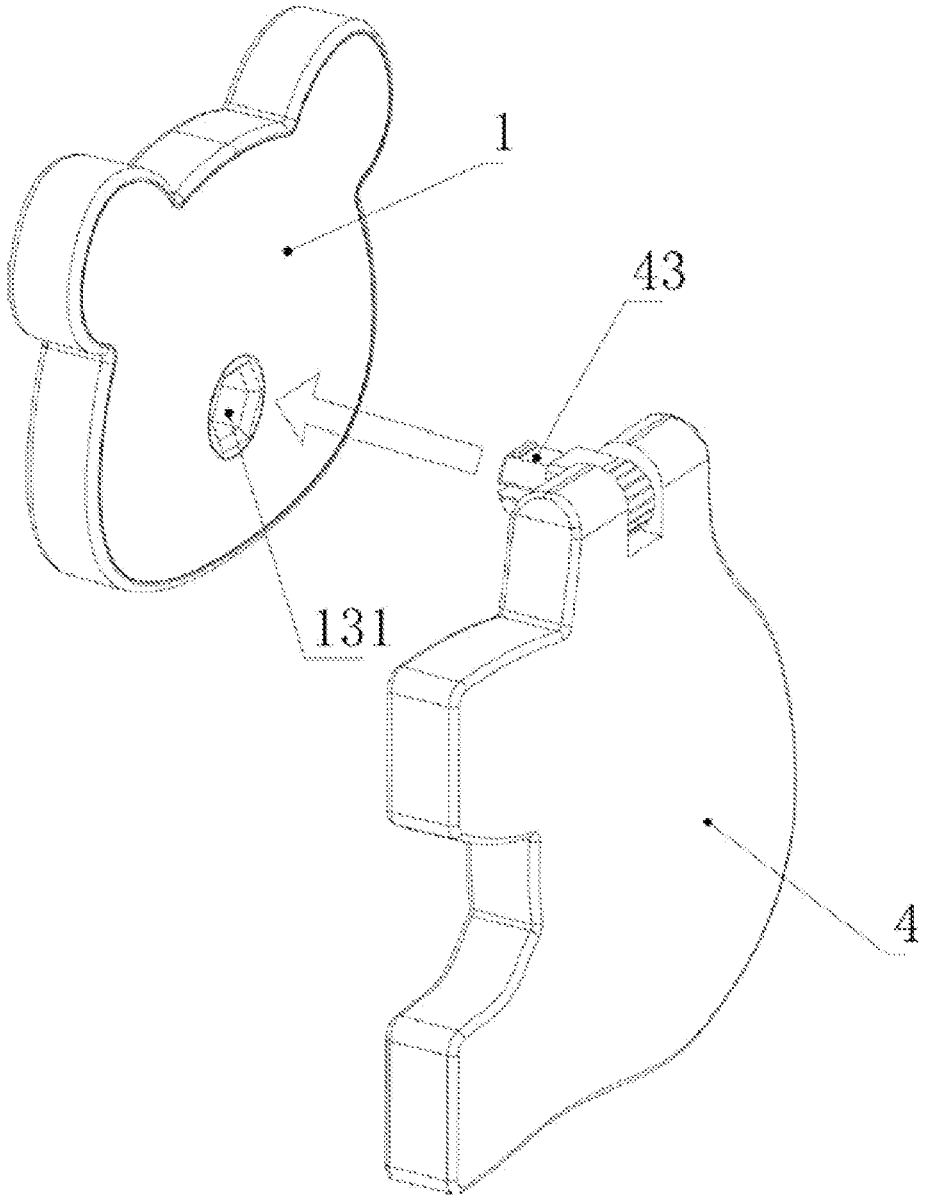
FIG. 14 is a schematic assembly diagram of a combined part building block and a head part building block in the application.

Referring to FIGS. 6 and 14, the shown combined part building block 4 is spliced into the assembly hole 131 in the movable gear of the head part building block 1 through the splicing pillar 43. After assembled, the shown splicing pillar 43 and the assembly hole 131 cannot slide rotationally relative to each other due to the polygonal assembly between their hole sites. In turning the combined part building block 4 or the head part building block 1, the movable gear 13 plucks the sounding plectrum 14 to make a bouncing sound whose intensity can be adjusted by changing the material and length of the sounding plectrum 14.

Figure 15:
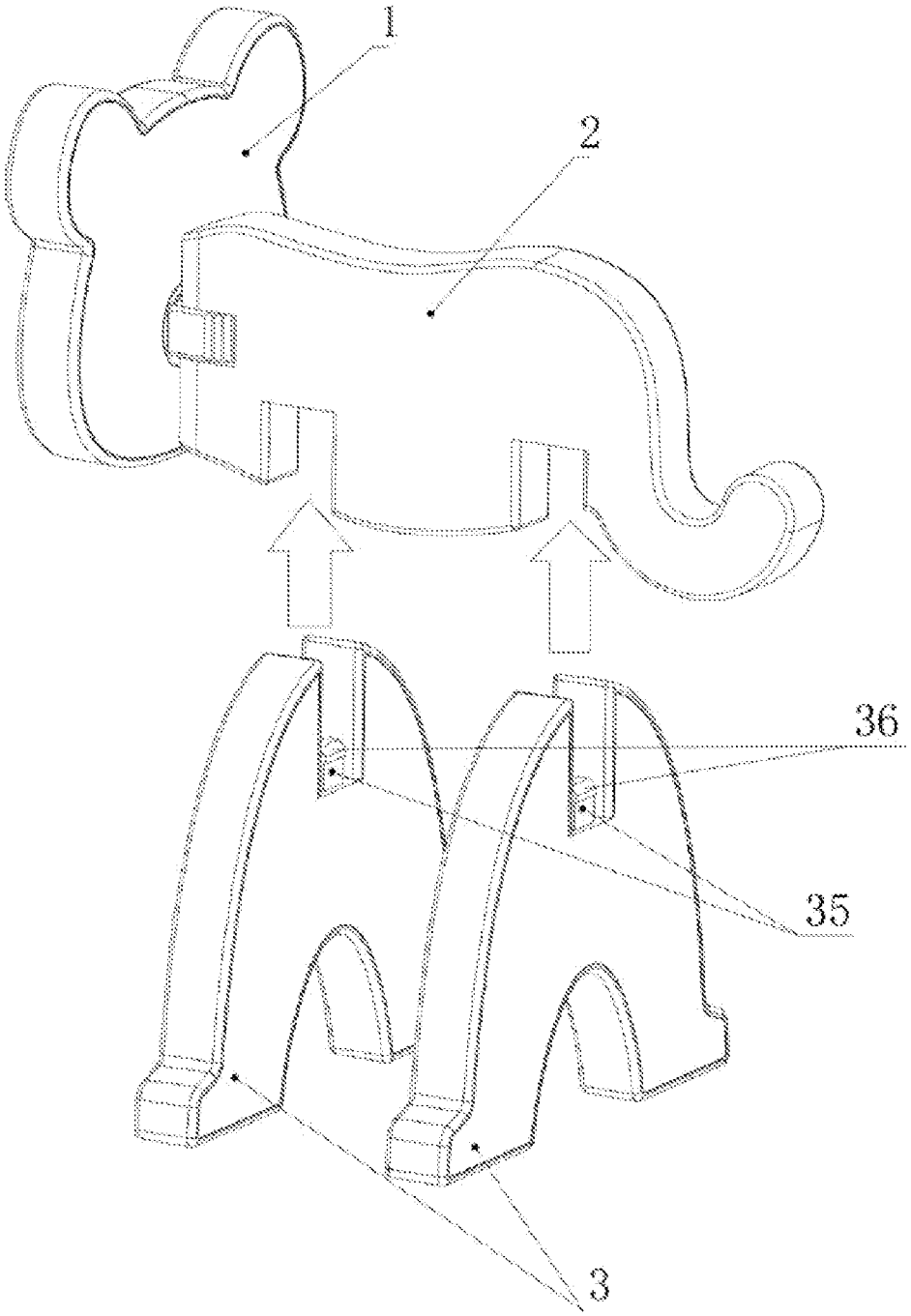
FIG. 15 is a schematic assembly diagram of a body part building block and limbs part building blocks in the application.
Figure 16:
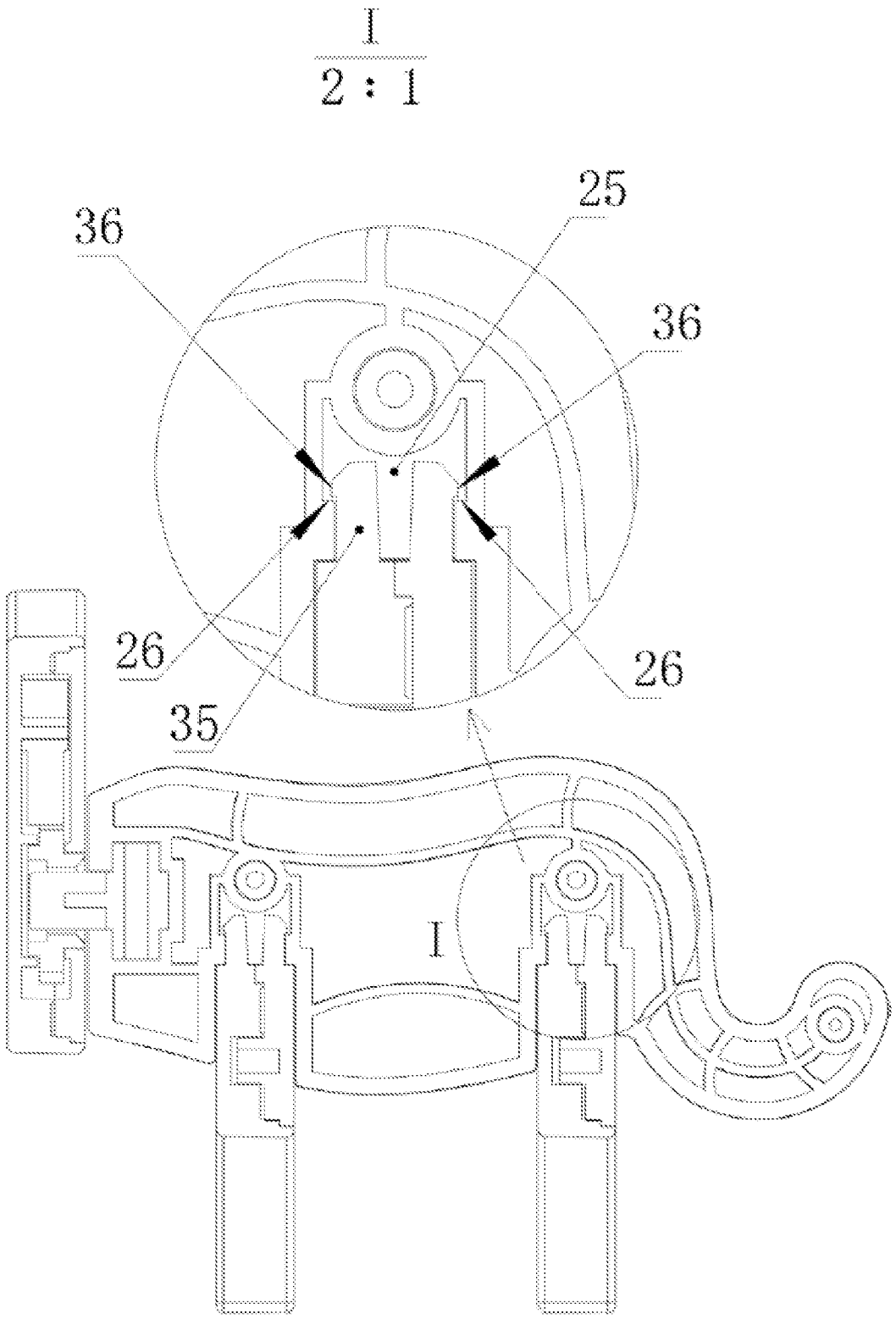
FIG. 16 is a cross-sectional view of the assembled interior of a body part building block and limbs part building blocks in the application.

Referring to FIGS. 15 and 16, the splicing buckles 35 of the limbs part building blocks are installed in the limbs installation cavities 25 of the body part building block 2. The barb steps 26 in the shown limbs installation cavities 25 cooperate with the barbs 36 on the splicing buckles 35 to improve the assembly tightness.

Referring to FIGS. 7 and 11, the shown splicing pillar 23 and splicing pillar 43 are of the same size structure, and the body movable cavity 24 and the body movable cavity 45 are of the same size structure.

Referring to FIGS. 9 and 11, the shown magnets 33 and magnets 44 are the same object, and the foot movable cavity 34 and the foot movable cavity 46 are of the same size structure.

Figure 17:
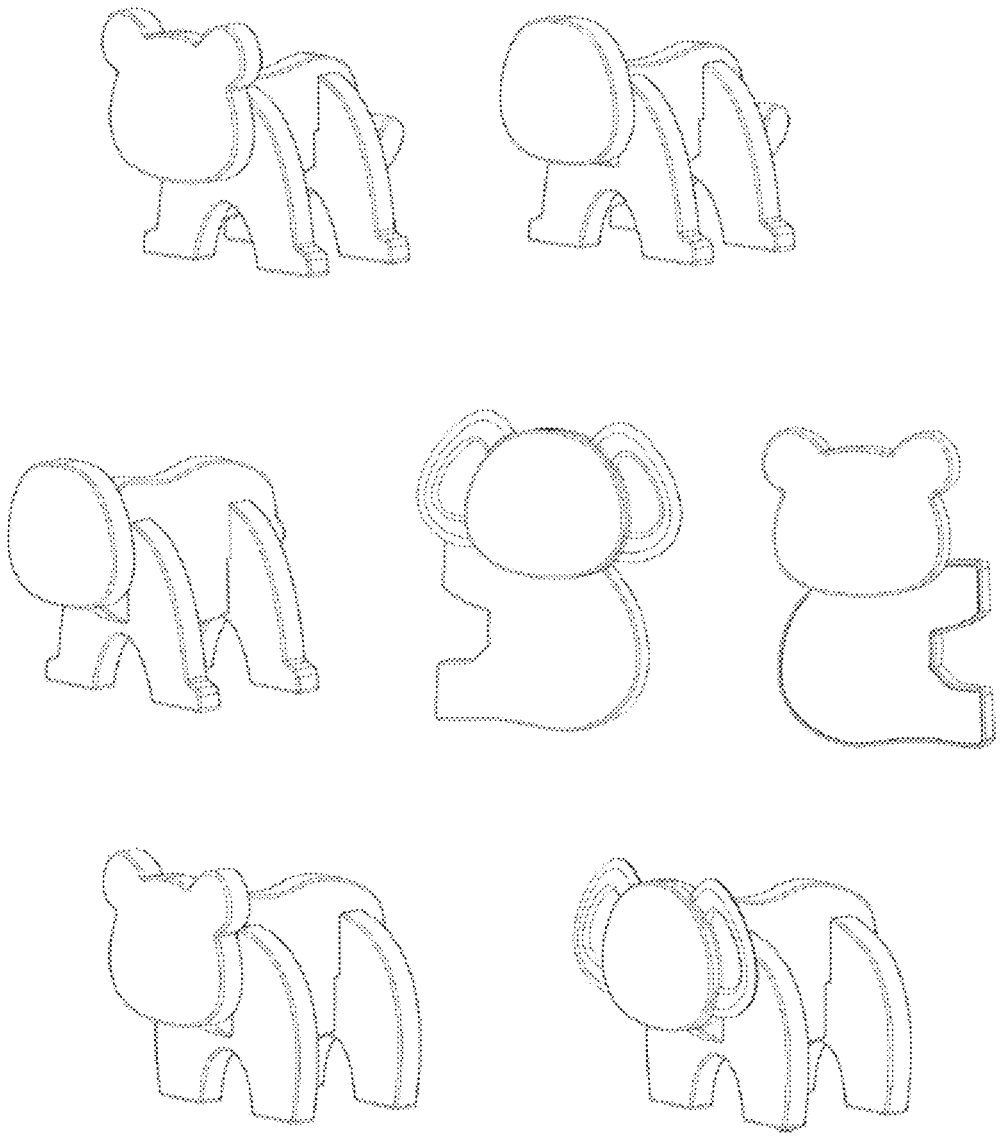
FIG. 17 is a schematic three-dimensional diagram of the assembled model embodiment in the application.

Referring to FIG. 17, what is shown is a schematic three-dimensional diagram of assembled toys 5 of several assembled embodiments.

What is claimed is:

1. A splicing animal building block toy, characterized by consisting of:

a head part building block, a body part building block, limbs part building blocks, and a combined part building block, wherein the body part building block and the combined part building block are spliced into an assembly hole in a movable gear of the head part building block through splicing pillars; in turning the body part building block, the combined part building block or the head part building block, the movable gear in the head part building block plucks a sounding plectrum to make a bouncing mechanical sound;

wherein the limbs part building blocks are spliced into limbs installation cavities of the body part building block through splicing buckles;

wherein barbs on the splicing buckles cooperate with barb steps in the limbs installation cavities;

wherein each of the limbs part building blocks consists of a limbs part building block base, a limbs part building block cover and first magnets, the first magnets are placed in first foot movable cavities formed by the limbs part building block base and the limbs part building block cover; magnetic poles of the first magnets are fixed and can rotate freely in the first foot movable cavities; and the limbs part building block base and the limbs part building block cover form the splicing buckle which is provided with the barb;

wherein the combined part building block consists of a combined part building block base, a combined part building block cover, a splicing pillar and second magnets; the splicing pillar is placed in a movable cavity formed by the combined part building block base and the combined part building block cover, and can rotate around an axis; the second magnets are placed in second foot movable cavities formed by the combined part building block base and the combined part building block cover; and magnetic poles of the second magnets are fixed and can rotate freely in the second foot movable cavities to change an external magnetic pole; and wherein the first magnets are not configured to connect the limbs part building blocks to the head part building block, the body part building block, or the combined part building block, and the second magnets are not configured to connect the combined part building block to the head part building block, the body part building block, or the limbs part building blocks.

2. The splicing animal building block toy according to claim 1, characterized in that:

the head part building block consists of a head part building block base, a head part building block cover, the movable gear and the sounding plectrum;

the movable gear is placed in a movable cavity formed by the head part building block base and the head part building block cover, and can move rotationally;

the movable gear is provided with the assembly hole in a center of the movable gear; and the sounding plectrum has a terminal end which is fixed, and head end of the sounding plectrum which meshes with teeth of the movable gear.

3. The splicing animal building block toy according to claim 1, characterized in that:

the body part building block consists of a body part building block base, a body part building block cover and a splicing pillar;

the splicing pillar is placed in a movable cavity formed by the body part building block base and the body part building block cover, and can rotate around an axis; and the body part building block base and the body part building block cover form the limbs installation cavities in which the barb steps are provided.

4. The splicing animal building block toy according to claim 1, characterized in that:

the body part building block and the combined part building block are spliced into the assembly hole in the movable gear of the head part building block through their respective splicing pillars;

each of the splicing pillars and the assembly hole cannot slide rotationally relative to each other after assembly; and in turning the body part building block, the combined part building block or the head part building block, the movable gear plucks the sounding plectrum to make a bouncing sound.

5. The splicing animal building block toy according to claim 1, characterized in that:

the body part building block is spliced into the splicing buckles of the limbs part building blocks through the limbs installation cavities; and the barb steps in the limbs installation cavities cooperate with the barbs in the splicing buckles.

* * * * *